US005812180A

United States Patent [19]

Masuda et al.

[11] Patent Number: 5,812,180

[45] Date of Patent: Sep. 22, 1998

[54] LASER RECORDING APPARATUS WHICH MAINTAINS THE LASER RECORDING UNIT IN A HORIZONTAL POSITION

[75] Inventors: Yoshiaki Masuda; Tadasu Taniguchi, both of Nara; Koichi Matsumoto, Gojo; Noriyuki Sakurai, Tokyo, all of Japan

[73] Assignee: Sharp Kabushiki Kaisha, Osaka, Japan

[21] Appl. No.: 680,240

[22] Filed: Jul. 11, 1996

[30] Foreign Application Priority Data

Sep. 20, 1995 [JP] Japan ..... 7-241787

[51] Int. Cl.[6] ..... B41J 2/47

[52] U.S. Cl. ..... 347/257; 347/263

[58] Field of Search ..... 347/263, 257, 347/170; 399/107, 110, 111, 125

[56] References Cited

U.S. PATENT DOCUMENTS 4,814,817 3/1989 Nishjima et al. ..... 399/125

5,200,781 4/1993 Hata ..... 399/125

FOREIGN PATENT DOCUMENTS 61-94065 5/1986 Japan .

2-157859 6/1990 Japan .

5-35057 2/1993 Japan .

*Primary Examiner*—Mark J. Reinhart

*Attorney, Agent, or Firm*—David G. Conlin; David D. Lowry

[57] ABSTRACT

A laser recording apparatus with a laser recording unit which is movable while held horizontal at all times. The laser recording apparatus is constructed of a first frame including the bottom section of the apparatus and a second frame supported by the first frame in a manner which allows pivotable rotation of the second frame for opening the apparatus, wherein a laser recording unit including laser scanning means is supported by the second frame on the rotation fulcrum, and the laser scanning means is held horizontal to the bottom section of the apparatus before, during and after release of the second frame from the first frame.

4 Claims, 5 Drawing Sheets

LASER RECORDING APPARATUS WHICH MAINTAINS THE LASER RECORDING UNIT IN A HORIZONTAL POSITION

BACKGROUND OF THE INVENTION

1. Field of the Invention

The present invention relates to a pivotably, vertically openable (clamshell type) image-forming laser apparatus, and more particularly to a mechanism and method for holding a laser scanning unit provided therein.

2. Description of the Related Art

The prior art includes pivotably, vertically openable (clamshell type) copying apparatuses which are designed to be vertically openable, with the copy sheet-feeding path as the boundary. When this type of copying apparatus is a laser copying apparatus comprising laser scanning means and a photoconductor which is exposed to scanning laser beams emitted from it, as illustrated in FIGS. 5A, 5B, a lower body 111 and an upper body 112 supporting laser scanning means 113 are designed to be opened around a hinge, with the copy sheet-feeding path as the boundary. Here, the laser scanning means 113 is held in a fixed positional relationship with the upper body 112 at all times (the movement keeping pace with the upper body provides a wide space to facilitate removal of jammed sheets).

A color image-forming apparatus is also known which is characterized in that a color processing unit integrally constructed of at least an image forming member and a plurality of developing devices is attached to the upper housing, and the processing unit is configured to be held roughly horizontal when it is opened vertically, released from the upper housing (Japanese Unexamined Patent Application Disclosure HEI 2-157859).

In addition, an image forming apparatus is known, where laser scanning means is attached to the upper body of an image forming apparatus with mounting screws and coiled springs in a state allowing three-dimensional displacement (Japanese Unexamined Patent Application Disclosure HEI 5-35057).

However, such apparatus wherein the laser scanning means 113 has a fixed positional relationship with the upper body 112 at all times or rotates in unison with the upper body of the copying apparatus, and those copying apparatuses not designed with consideration to the positions of rotation fulcra have many problems, including the following:

1) Since the laser scanning means 113 is held at an angle during maintenance as a result of its rotation in conjunction with the upper body 112, the working efficiency is low, and the laser scanning means 113 has the risk of falling out;
2) When the upper body is raised open in order to remove a jammed sheet before a polygonal motor 114 for the laser scanning means 113 is completely stopped, since the laser scanning means 113 is inclined, the shaft section of the motor may receives three-dimensional shock to the point of breaking the bearing/shaft section of the polygonal motor 114; and
3) Operations for opening and closing the body of the copying apparatus cause great shock or vibration to be exerted on the components in the laser scanning means 113, such as an f-θ lens, mirror and laser emitting device, and further cause considerable positional changes in the components before and after opening and closing of the body due to movement of the laser scanning means 113 to the same extent as the upper body 112, thus sometimes presenting poor image quality problems.

SUMMARY OF THE INVENTION

The laser recording apparatus according to the present invention comprising:

laser beam-emitting means for emitting laser beams modulated based on image signals;

laser scanning means which rotates to scan the laser beams emitted by the laser beam-emitting means; and a photoconductor which is exposed to the laser beams scanned by the laser scanning means, characterized in that it is further constructed of a first frame including the bottom section of the apparatus, and a second frame which is supported with respect to the first frame in a state which allows pivotable rotation of the second frame for opening, wherein a laser recording unit including the laser scanning means is supported by the second frame at the rotation fulcrum, and the laser scanning means is held horizontal to the bottom surface of the apparatus before, during and after release of the second frame from the first frame.

The laser recording apparatus according to the present invention is further characterized in that the laser recording unit has a reflecting mirror member for guiding the laser beams deflected by the laser scanning means toward the photoconductor, and the reflecting mirror member is located near the rotation fulcrum of the laser recording unit.

The laser recording apparatus according to the present invention is further characterized in that the laser recording unit has a reflecting mirror member for guiding the laser beams deflected by the laser scanning means toward the photoconductor, and the reflecting mirror member is located on the other side of the laser scanning means, with respect to the rotation fulcrum of the laser recording unit.

The laser recording apparatus according to the present invention is further characterized in that the processing frame including the photoconductor is supported by the first frame, and remains in a state such that a section of contact provided on the laser recording unit is held in contact with the processing frame while the laser recording unit rotates about the rotation fulcrum.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Embodiments of the present invention will now be explained with reference to FIG. 1 through FIG. 3. Here, the embodiments are of digital copying machines which use laser scanning means.

Figure 1:
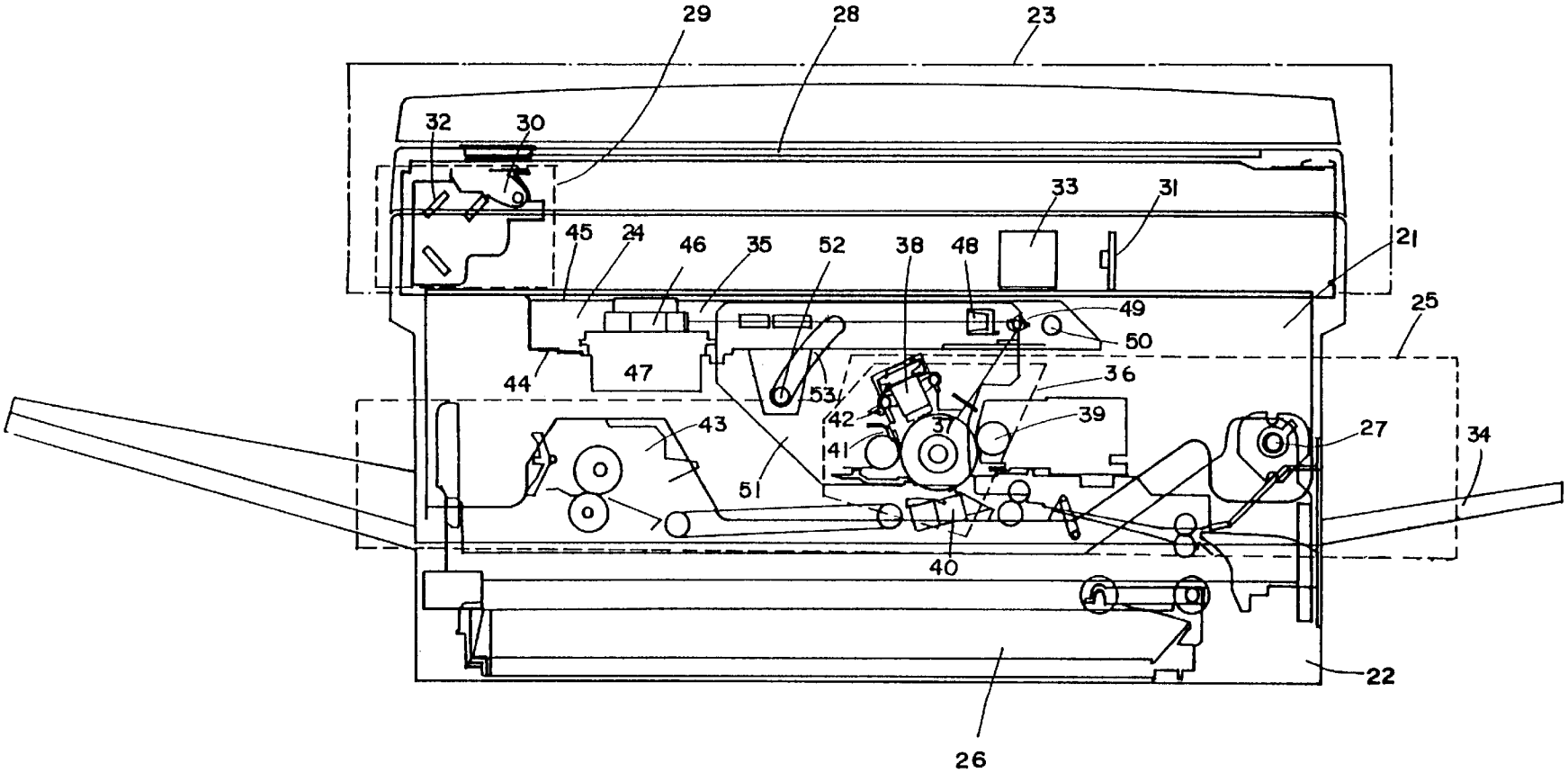
FIG. 1 is a side view of a clamshell-type digital copying machine, as an embodiment of the laser recording apparatus according to the present invention.

In FIG. 1, the body of a digital copying machine is constructed as a vertically openable type (a clamshell type), with the copy sheet-feeding path as the boundary. A second on upper frame 21 is equipped with a scanning section 23, and a laser recording unit 24 including laser scanning means is also supported by the second frame 21. Further, a printing section 25 and a copy sheet-feeding section 26, excluding the laser recording unit 24, are provided in a first or lower frame 22. The first frame 22 and the second frame 21, supported on a rotation fulcrum 27 illustrated in FIG. 1, are designed to be vertically openable.

The scanning section 23 is equipped with a document station 28 and a scanning unit 29. In the copy sheet-feeding section (unit) 26, the sheets stacked in a cassette are sent sheet by sheet to the printing section 25, starting with the uppermost one.

The scanning unit 29 is equipped with a lamp reflector assembly 30 for exposing documents, a plurality of reflecting mirrors 32 for guiding light beams reflected from the documents to a charge-coupled device (CCD) 31, and a lens 33 for focusing the light beams reflected from the documents into image on the charge-coupled device (CCD) 31.

Image data obtained by reading an original image with the scanning unit 29 is sent to an image processing section (not shown) for various processing, and then sent to the printing section 25 in response to an output command to form the image on a sheet.

The printing section 25 is equipped with a tray 34 for manually feeding copy sheets, a laser recording unit 24 and an electrophotographic processing section 36.

The electrophotographic processing section 36 is constructed in a conventional manner, with a charging device 38, a developing device 39, a transferring device 40, a cleaning device 41, an antistatic device 42 and a fixing device 43 positioned around a photoconductor 37. Accordingly, the image data sent from the image processing section is outputted as laser beams from the laser scanning means 35 to form an electrostatic latent image on the surface of the photoconductor 37. The electrostatic latent image is made visible with toner in the developing device 39 as a toner image, and this toner image is transferred onto a sheet conveyed from the copy sheet-feeding section (unit) 26 to be fixed on the sheet by the fixing device 43, and the sheet is then ejected via the fixing device.

The laser recording unit 24 according to the invention will now be explained in detail. The laser recording unit 24 is constructed as a unit composed of a base frame 44 and an upper cover 45. Provided inside it are a semiconductor laser (not shown) for emitting laser beams based on the image data from the image processing section, a light source section (not shown) including a collimating lens, a polygonal mirror 46 for deviating the laser beams at a constant angular speed, a polygonal motor 47 for directly driving the polygonal mirror 46 to rotate, an f-θ lens 48 for correction so that the laser beams deviated at a constant angular speed are deviated on the photoconductor 37 in the electrophotographic processing section 36 at a constant angular speed, and a reflecting mirror 49 for reflecting and guiding the laser beams deflected at a constant angular speed toward the photoconductor 37.

Further, the laser recording unit 24 has the rotation fulcrum on the right-hand side (FIG. 3) or the left-hand side (FIG. 4) of the laser scanning means 35, supported by the second frame 21 in a rotatable manner. Further, the laser recording unit 24 is supported at the side opposite to the rotation fulcrum in a movable state in contact with a processing frame 51 supporting the photoconductor 37 in the electrophotographic processing frame 51 which is in turn supported by the first frame 22.

Here, the processing frame 51 supporting the photoconductor 37 in the electrophotographic processing section 36 is fixed through exact and reliable positioning particularly with respect to the first frame 22 in order to perform reliable, high-precision positioning of the respective components of the image-forming apparatus, which is important for improving the image quality.

Figure 2A:
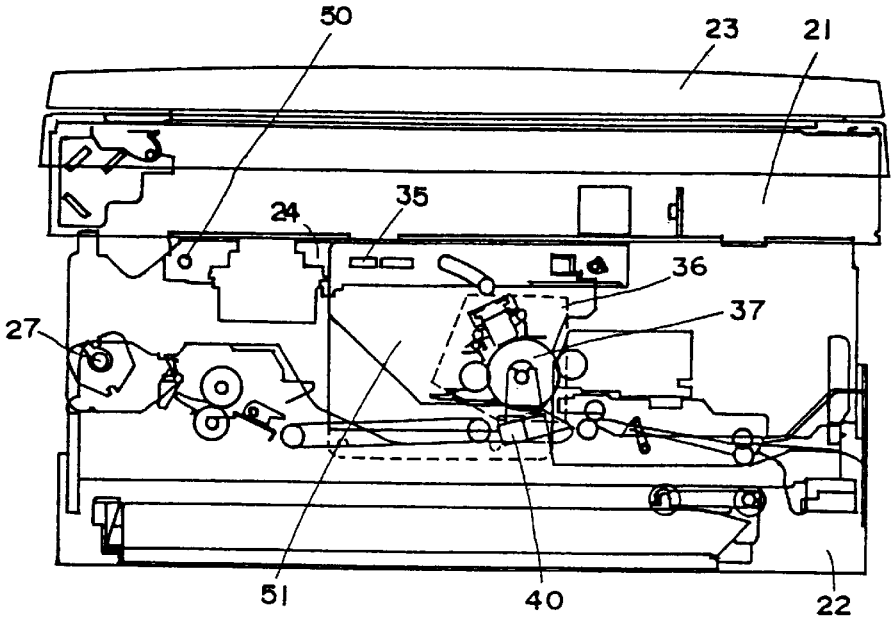
FIG. 2A is a view illustrative of a method for positioning to fix a processing frame with respect to a first frame according to the invention (closed state), and FIG. 2B a view illustrative of a method for positioning to fix a processing frame with respect to a first frame, according to the invention (opened state)
Figure 2B:
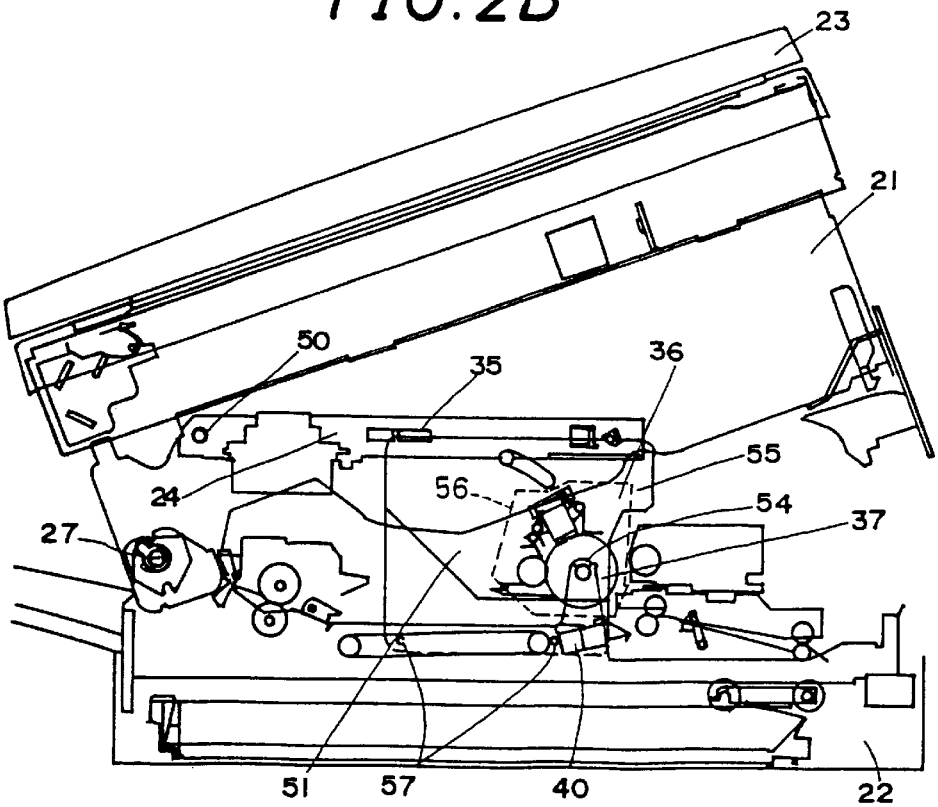

FIGS. 2A, 2B illustrate a method for positioning the processing frame 51 supporting the photoconductor 37 in the electrophotographic processing section 36. The processing frame 51 is positioned with the processing frame F 55 fixed with a drum shaft flange 54 at the front side of the recording apparatus body, and with the processing frame R 56 fixed to the first frame 22 with a screw 57 or the like at the rear side of the recording apparatus body.

An explanation will now be given regarding the rotational operation of the second frame 21 and the rotational operation of the laser recording unit 24 during sheet jamming and maintenance of the clamshell-type digital copying machine mentioned above. The second frame 21 rotates about the rotation fulcrum 27 of the copying machine body, relative to the first frame 22, and the second frame 21 is released at the end of the operation. Here, the laser recording unit 24 rotates about the rotation fulcrum 50 independently of the second frame 21, while keeping the laser scanning means 35 in a horizontal state at all times during the rotational operation. This rotation is accomplished by providing the processing frame 51 with a guiding member 53 which extends along the orbit of another fulcrum 52 opposite to the rotation fulcrum 50 of the laser recording unit 24 which rotates in a horizontal state at all times. The guiding member 53 may be shaped as a rail or a slit so long as it allows operation of the laser recording unit 24 while in contact therewith.

The rotational operation of the laser recording unit 24 is the same for digital copying machines of the configuration (layout) mentioned above, regardless of whether the rotation fulcrum 27 of the first frame 22 and the second frame 21 of the copying machine body are located at the side of the copy sheet-feeding section or the copy sheet-ejecting section. The released state of the copying machine body and the state of the laser recording unit 24 when it is held or released will now be explained.

Figure 3:
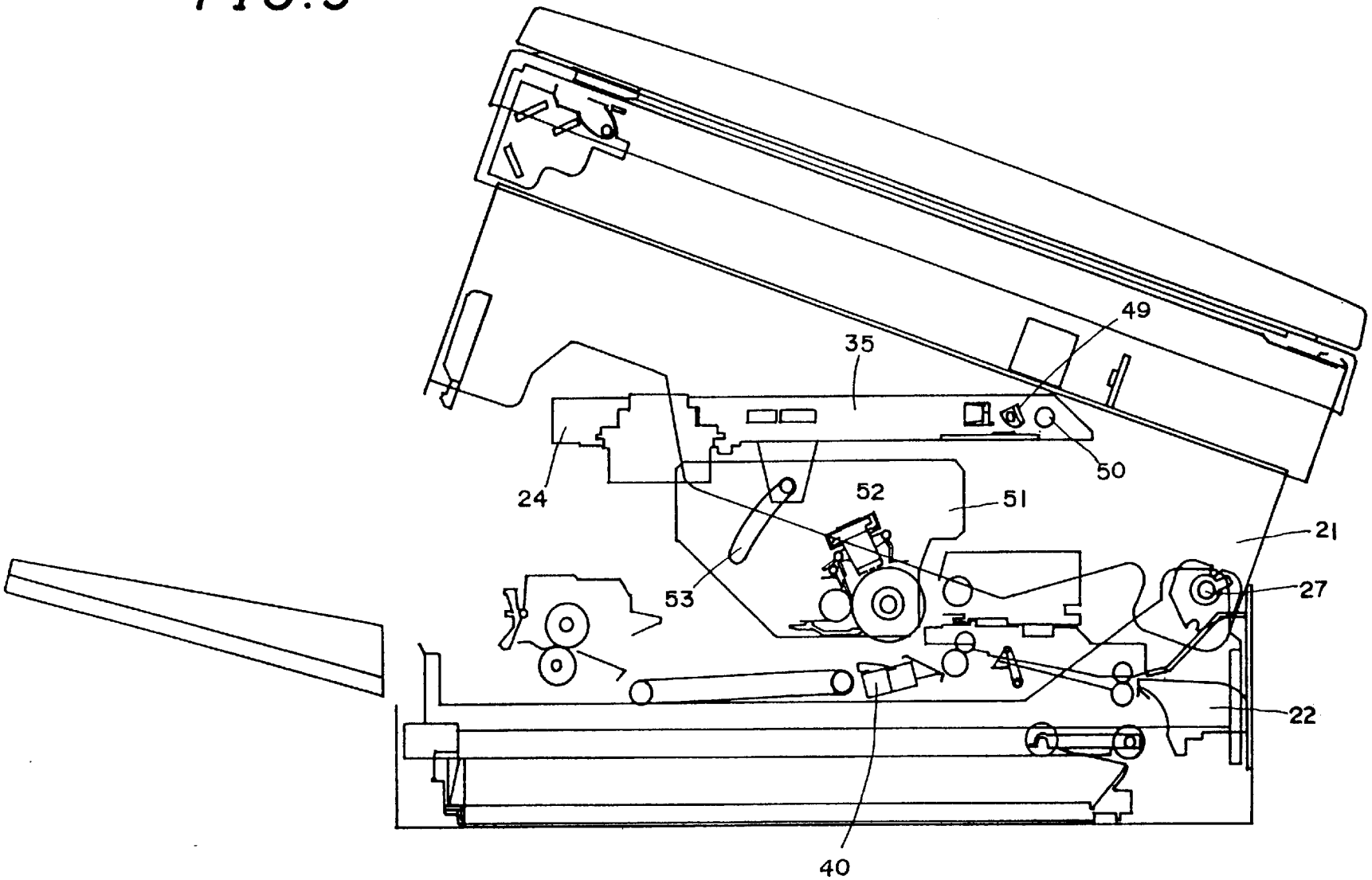
FIG. 3 is a side view illustrative of another embodiment of the laser recording apparatus according to the invention, wherein the rotation fulcra of the first and the second frames are at the copy sheet-feeding side (opened state)

FIG. 3 illustrates the released state according to an embodiment of the invention, wherein the rotation fulcrum 27 of the first frame 22 and the second frame 21 of the copying machine body is provided at the side of the copy sheet-feeding section. With this configuration, the reflecting mirror member 49 for guiding the laser beams deflected by the laser scanning means 35 to the photoconductor 37 is positioned near the rotation fulcrum 50 of the laser recording unit 24, as a result of the positional relationship of the components in the scanning means.

Figure 4:
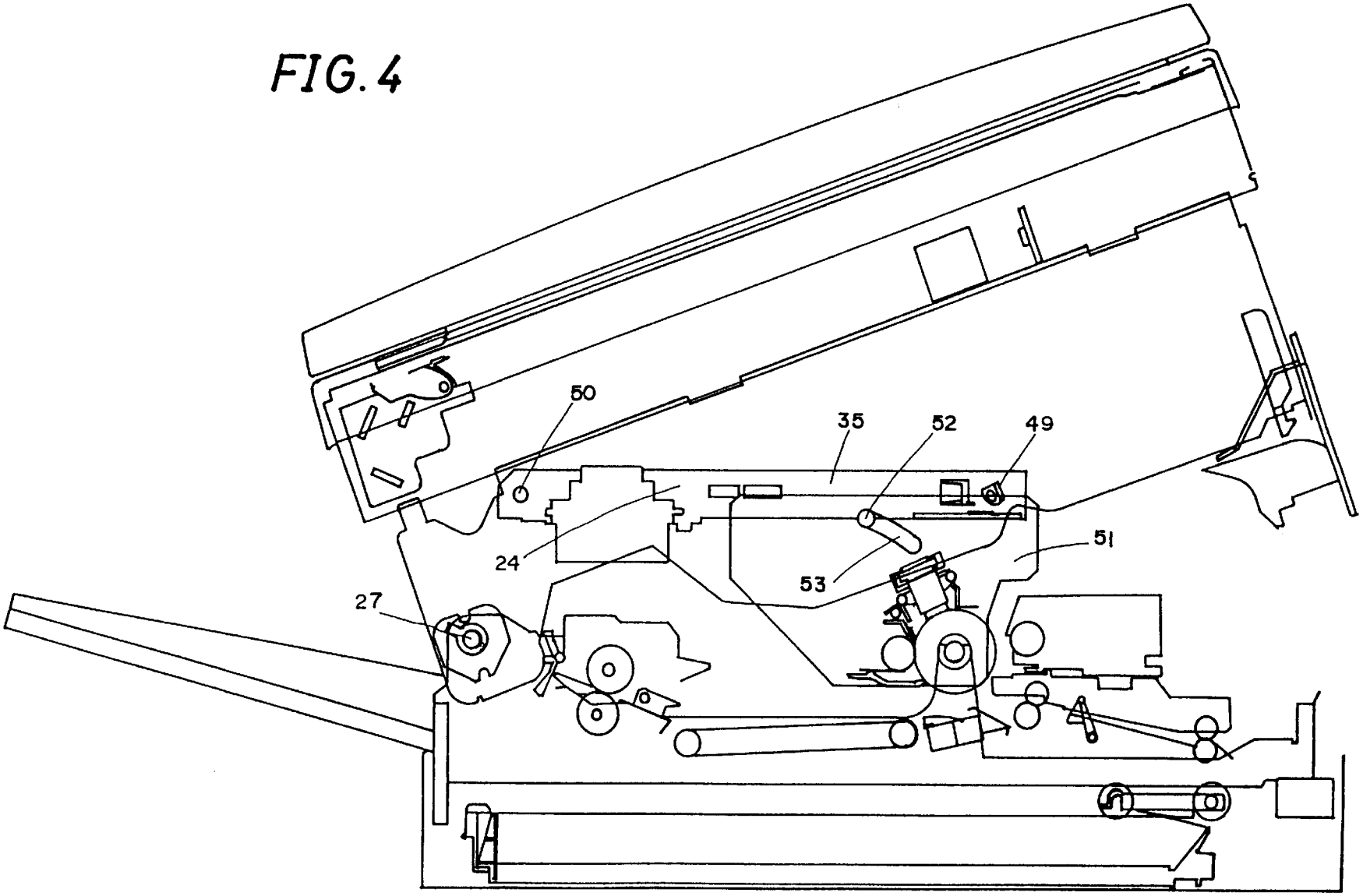
FIG. 4 is a side view illustrative of yet another embodiment of the laser recording apparatus according to the invention, wherein the rotation fulcra of the first and the second frames are at the copy sheet-ejecting side (opened state)
Figure 5A:
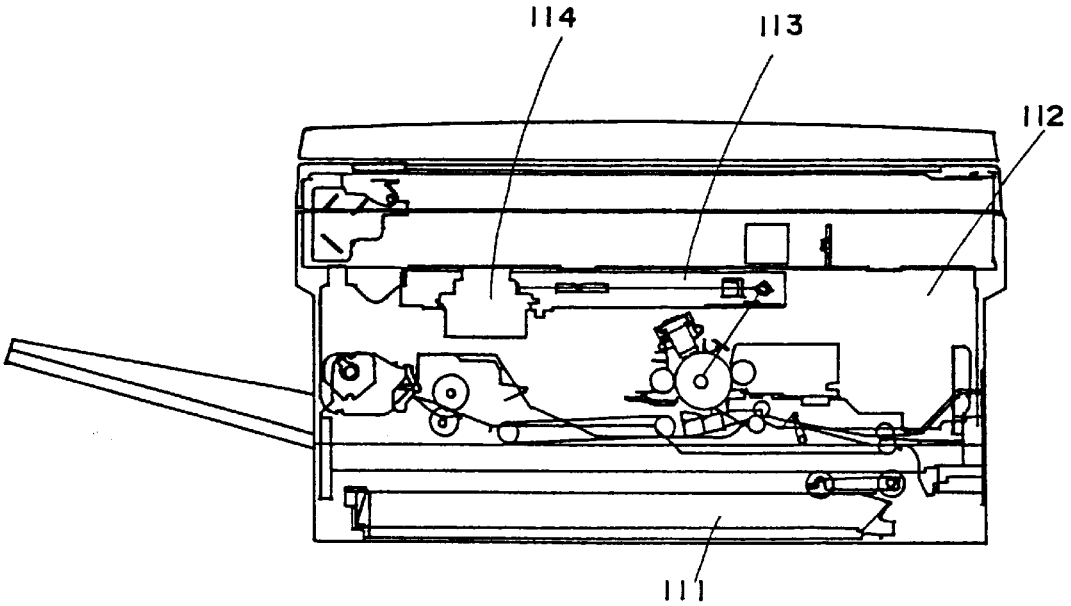
FIG. 5A is a schematic side view of a clamshell-type digital copying machine according to the prior art (with the upper unit closed)
Figure 5B:
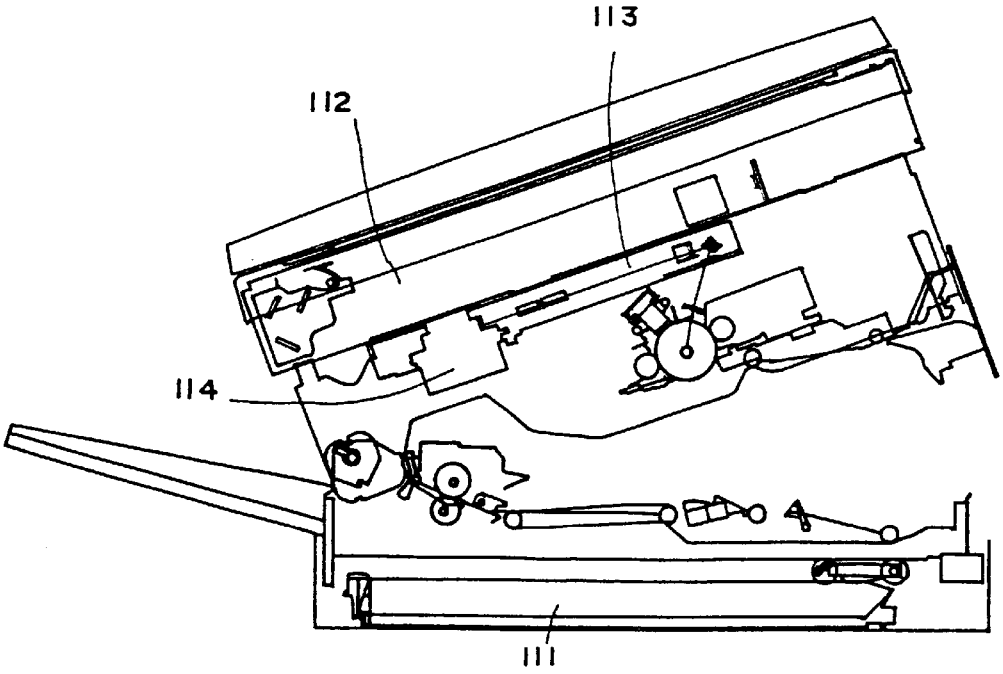
FIG. 5B is a schematic side view of a clamshell-type digital copying machine according to the prior art (with the upper unit opened).

FIG. 4 illustrates the released state according to another embodiment of the present invention, wherein the rotation fulcrum 27 of the first frame 22 and the second frame 21 of the copying machine body is provided at the side of the copy sheet-ejecting section. With this configuration, the reflecting mirror member 49 for guiding the laser beams deflected by the laser scanning means 35 to the photoconductor 37 is positioned at the other side of the laser scanning means 35, opposite to the rotation fulcrum 50 of the laser recording unit 24.

Whether the rotation fulcrum 50 of the laser recording unit 24 is provided at the copy sheet-feeding side or the copy sheet-ejecting side in the copying machine body, however, does not adversely affect the state of the laser recording unit 24 which is held horizontal at all times while in contact with the guiding section 53 of the processing frame 51, during rotational operation of the second frame 21 of the body.

As explained above, the embodiments of the present invention allow the laser scanning means 35 to be held horizontal at all times during release of the copying machine body, and allow control of the rotational operation of the laser scanning means 35 at the start of, during and after release of the body to prevent three-dimensional shock and vibration.

With the laser recording apparatus according to the invention, the second frame must be opened for maintenance of the laser scanning means or in order to remove jammed sheets. However, since the laser scanning means moves while in a horizontal state at all times, supported on the rotation fulcrum unlike the rotating frame which is released at an angle, and rests in a horizontal state as well, the working efficiency for removing the laser scanning means is increased, and three-dimensional shock to the shaft of the polygonal motor which may be caused by its inclination is relieved.

According to an embodiment of the invention, in cases where rotation occurs in the laser recording apparatus according to the present with the center of rotation at the copy sheet-feeding side, provision of the reflecting mirror which reflects and guides the laser beams deflected by the laser scanning means toward the photoconductor, in the laser recording unit, at the rotation fulcrum side, allows reduction in the range of rotational movement of the reflecting mirror in the laser scanning means while rotation occurs in the laser recording apparatus, and this improves its positional precision with respect to the photoconductor as an joint effect with minimized shock and vibration to the reflecting mirror.

According to another embodiment of the invention, in cases where rotation occurs in the laser recording apparatus according to the invention with the center of rotation at the copy sheet-ejecting side, provision of the reflecting mirror which reflects and guides the laser beams deflected by the laser scanning means toward the photoconductor, in the laser recording unit, at its side opposite to the rotation fulcrum, that is, provision of the rotation fulcrum at the side of the polygonal motor, allows setting of the center of gravity of the laser scanning means near the polygonal motor for which the vibration/shock-resistance design is the most important, of the components of the laser scanning means, and which is subject to increased parts weight depending on the copying speed and resolution of the laser recording apparatus.

In addition, even when the polygonal motor has not been completely stopped during the rotational operation for the laser recording apparatus, since the range of the rotational operation of the polygonal motor in the laser scanning means is small, and it is also securely supported by the rotating frame at the rotation fulcrum, even lateral vibration may be prevented, and thus the shaft section of the motor may be protected from three-dimensional shock to prevent impairment of the polygonal motor even when the laser recording apparatus undergoes a rotational operation during inertial rotation of the polygonal motor.

According to a characteristic aspect of the invention, since the laser scanning means of the laser recording apparatus moves while in constant contact with part of the photoconductor unit supported by the fixed frame, before, during and after release of the rotatable frame by which the laser scanning means is supported in a related manner, reduction in the image quality, which is caused by change in the positional relationship between the laser scanning means and the photoconductor unit due to opening or closing of the rotatable frame, may be prevented even in cases where the laser recording apparatus undergoes slight changes in the positional relationship which may result from repetition of the rotational operation or even slight shock to the laser scanning means. This is because the positional precision of the laser scanning means with respect to the photoconductor is determined only by its positional relationship with the photoconductor unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A laser recording apparatus including laser beam-emitting means for emitting laser beams modulated based on image signals, laser scanning means which rotates to scan the laser beams emitted by the laser beam-emitting means, and a photoconductor which is exposed to the laser beams scanned by the laser scanning means, said laser recording apparatus comprising:

a first frame containing the bottom section of the apparatus; and a second frame which is supported by the first frame at a first rotation fulcrum, wherein a laser recording unit including the laser scanning means is supported by a scanning section in the second frame at a second rotation fulcrum, and a third rotation fulcrum of the laser recording unit is guided along a guiding member of the first frame, whereby a horizontal state of the laser recording unit is maintained.

2. The laser recording apparatus according to claim 1, wherein the laser recording unit has a reflecting mirror member for guiding the laser beams deflected by the laser scanning means toward the photoconductor, and the reflecting mirror member is located near the first rotation fulcrum of the laser recording unit.

3. The laser recording apparatus according to claim 1, wherein the laser recording unit has a reflecting mirror member for guiding the laser beams deflected by the laser scanning means toward the photoconductor, and the reflecting mirror member is located on the other side of the laser scanning means, with respect to the first rotation fulcrum of the laser recording unit.

4. The laser recording apparatus according to claim 1, wherein a processing frame including the photoconductor is supported by the first frame, and remains in a state such that a section of contact provided on the laser recording unit is held in contact with the processing frame while the laser recording unit first rotates about the rotation fulcrum.

* * * * *